US012311246B1

(12) United States Patent
Arnold

(10) Patent No.: US 12,311,246 B1
(45) Date of Patent: May 27, 2025

(54) PUTTING AID

(71) Applicant: Jake Eto Arnold, Thornton, CO (US)

(72) Inventor: Jake Eto Arnold, Thornton, CO (US)

( * ) Notice: Subject to any disclaimer, the term of this patent is extended or adjusted under 35 U.S.C. 154(b) by 124 days.

(21) Appl. No.: 17/990,604

(22) Filed: Nov. 18, 2022

(51) Int. Cl.
*A63B 69/36* (2006.01)

(52) U.S. Cl.
CPC ..... *A63B 69/3685* (2013.01)

(58) Field of Classification Search
CPC ..... A63B 69/3685
USPC ..... 473/219, 226, 227, 231, 236, 238, 239, 473/244, 251, 257, 267, 268
See application file for complete search history.

(56) References Cited

U.S. PATENT DOCUMENTS 4,002,343 A * 1/1977 Eckert ..... A63B 69/3632 473/251
5,011,153 A * 4/1991 Watkins ..... A63B 69/3685 473/236
5,810,675 A 9/1998 Weathers
6,146,285 A * 11/2000 Winslow ..... A63B 69/3685 473/219
6,450,903 B1 9/2002 Tate
6,464,596 B1 * 10/2002 Belding ..... A63B 69/3685 473/251
6,827,655 B2 * 12/2004 Burns ..... A63B 69/3685 473/236
7,396,288 B2 * 7/2008 McLauhglin ..... A63B 69/3685 473/238
8,827,825 B2 9/2014 Kaufman
9,149,706 B2 * 10/2015 Mudgett ..... A63B 69/3685
2006/0030419 A1 2/2006 Koster
2006/0276258 A1 * 12/2006 McLaughlin ..... A63B 69/3685 473/236

OTHER PUBLICATIONS

GolfGiftsGallery.com [online], "Dave Pelz Sweet Spot Putting Clips," 2015, retrieved on Dec. 16, 2022, retrieved from URL<https://www.golfgiftsgallery.com/products/dp4008-sweet-spot-putting-clips?variant-36652080070813&currency=USD&utm_medium=product_sync&utm_source-google&utm_content=sag_organic&utm_campaign=sag_organic>, 6 pages.

* cited by examiner

*Primary Examiner* — Nini F Legesse
(74) *Attorney, Agent, or Firm* — Fish & Richardson P.C.

(57) ABSTRACT

A putter training aid has a first tab, a second tab, and a link. The first tab and second tab reside at an impact face of a head of a golf putter. The second tab is spaced from the first tab. The link is coupled to the first tab and the second tab. The link aligns, with the putter training aid releasably mounted on the head, with a sweet spot of the impact face to position the first tab and the second tab at the impact face bounding a region of the impact face defined between the first tab and the second tab. The region includes the sweet spot. The first tab and the second tab constrain, with the training aid releasably mounted on the head and the link aligned with the sweet spot, the region of the impact face to strike a golf ball only with the sweet spot.

13 Claims, 5 Drawing Sheets

PUTTING AID

FIELD OF THE DISCLOSURE

This disclosure relates to golf equipment, and particularly to golf training aids.

BACKGROUND

There are multiple types of golf clubs, such as woods, irons, hybrids, and putters. Putters are mainly used to make short strokes to roll the golf ball into the cup. Such strokes need to be precise to move the golf ball in the right direction. Golf training aids can help a user learn how to use a putter.

SUMMARY

Implementations of the present disclosure include a putter training aid that has a first tab, a second tab, and a link. The first tab resides at an impact face of a head of a golf putter. The second tab is spaced from the first tab and it resides at the impact face. The link is coupled to the first tab and the second tab. The link aligns, with the putter training aid releasably mounted on the head, with a sweet spot of the impact face to position the first tab and the second tab at the impact face bounding a region of the impact face defined between the first tab and the second tab. The region includes the sweet spot. The first tab and the second tab constrain, with the putter training aid releasably mounted on the head and the link aligned with the sweet spot, the region of the impact face to strike a golf ball only with the sweet spot.

In some implementations, the link has a first arm coupled to (and extending from) the first tab, a second arm coupled to (and extending from) the second tab, and a link arm coupled to the first arm and the second arm. The link arm forms, with the putter training aid mounted on the head and the first arm and the second arm resting on a top surface of the head, a space between the link arm and the top surface of the head to allow a user to see, from above the head and while putting, at least a portion of the top surface of the head and at least a portion of a cavity of the head.

In some implementations, the head is made of a magnetic material and at least one of the first arm or the second arm includes an arm magnet. The arm magnet faces, with the putter training aid mounted on the head, the top surface to magnetically couple the putter training aid to the top surface.

In some implementations, the second tab is spaced from the first tab to define a gap therebetween. The gap includes a mid-point that is aligned, with the link aligned with the sweet spot and the putter training aid mounted on the head, with the sweet spot of the impact face. In some implementations, the link includes a visual marker at a top surface of the link. The visual marker is aligned with the mid-point of the gap. The visual marker aligns with a central marker disposed at the cavity or the top surface of the head or both to align the mid-point of the gap with the sweet spot of the impact face.

In some implementations, the head is made of a magnetic material and at least one of the first tab or the second tab includes a tab magnet. The tab magnet faces, with the putter training aid mounted on the head, the impact face to magnetically couple the putter training aid to the impact face.

Implementations of the present disclosure also include a putter training aid assembly that including a bracket and an arm. The bracket has a first tab, a second tab spaced from the first tab, and a link coupled to the first tab and the second tab. The link aligns, with the bracket releasably mounted on a head of a golf putter, with a sweet spot of an impact face of the head to position the first tab and the second tab at the impact face bounding a region of the impact face including the sweet spot. The arm is coupled to the link. The arm bears, with the putter training aid assembly releasably mounted on the head and the arm engaging the link, against a surface of a shaft of the golf putter to bias the first tab and the second tab against the impact face. The first tab and the second tab constrain, with the putter training aid assembly releasably mounted on the head and the link aligned with the sweet spot, the region of the impact face to strike a golf ball only with the sweet spot.

In some implementations, the arm includes a first end including a first surface and a second end opposite the first end and including a second surface facing away from the first surface. The arm includes a middle section angled with respect to the first end and second end. The first surface bears, with the putter training aid assembly releasably mounted on the head and the arm engaging the link, against the shaft. The second surface bears against the link to urge the first tab and second tab against the impact face of the golf putter, adding stability to the mounted bracket.

In some implementations, the shaft is made of a magnetic material and the first surface includes a magnet that magnetically couples the arm to the shaft. The second surface has a pin that is inserted into an aperture of the link to releasably couple the arm to the link and allow, with the putter training aid assembly mounted on the head, the arm to push the link in a direction away from the impact face of the head.

In some implementations, the link has a first tab arm fixed to and extending from the first tab, a second tab arm fixed to and extending from the second tab, and a link arm fixed to the first tab arm and the second tab arm. The link arm forms, with the bracket mounted on the head and the first tab arm and the second tab arm resting on a top surface of the head, a space between the link arm and the top surface of the head to allow a user to see, from above the head and while putting, a central marker. The central marker is disposed at a cavity of the head or the top surface of the head or both. The central marker is aligned with the sweet spot of the impact face.

In some implementations, the head is made of a magnetic material and at least one of the first tab arm or the second tab arm includes a magnet. The magnet faces with the bracket mounted on the head, the top surface to magnetically couple the bracket to the top surface.

In some implementations, the first tab arm and the second tab arm have a length of between 0.5 and 2 inches, and the first and second tabs define a gap therebetween. The gap is between 1 and 2 inches long.

Implementations of the present disclosure include a putter training aid arm that has a first arm section, a second arm section, and a third arm section. The first arm section has a first surface. The second arm section extends parallel with respect to the first arm section and has a second surface that faces away from the first surface. The third arm section is coupled to (and is disposed between) the first arm section and the second arm section. The third arm section extends at an angle with respect to the first arm section and the second arm section. The putter training aid arm extends from a putter training aid bracket releasably mounted on a head of a golf putter such that, with the putter training aid bracket and arm mounted on the head, the first surface bears against a shaft of the golf putter and the second surface biases two tabs of the putter training arm bracket against an impact face of the golf putter. This adds stability to the mounted putter training aid bracket.

In some implementations, the third arm section extends at angle of between 10° and 30° with respect to the first arm section and the second arm section.

In some implementations, the shaft is made of a magnetic material and the first surface includes a magnet configured to magnetically couple the arm to the shaft. The second surface includes an engagement member that interfaces with a coupling surface of the link facing the second surface to releasably couple the arm to the link and allow, with the putter training aid arm and bracket mounted on the head, the arm to push the link away from the impact face of the head and thereby bias the two tabs of the putter training arm bracket against the impact face of the golf putter.

In some implementations, the engagement member has a pin and the coupling surface of the link has a corresponding hole configured to receive the pin to engage with the arm.

In some implementations, the coupling surface of the link extends outwardly from a link arm of the link to face the shaft or a back surface of the head such that the arm engages the shaft and the coupling surface with the link disposed along a plane extending across the coupling surface and the shaft.

In some implementations, the arm extends along a central plane of the arm extending along the length of the arm. The first surface and the second surface include respective longitudinal central axes aligned with the central plane, and the arm is either fixed to the bracket or releasably coupled to the bracket.

Implementations of the present disclosure include a method of using a putter training aid. The method includes mounting the putter training aid on a head of the putter. The putter training aid includes a bracket and an arm coupled to the bracket. The bracket has a first tab, a second tab spaced from the first tab, and a link coupled to the first tab. The arm is attached to the link and bears against a shaft of the putter. The method also includes aligning the link with a sweet spot of an impact face of the head to position the first tab and the second tab at the impact face bounding a region of the impact face including the sweet spot to constrain the region of the impact face to strike a golf ball only with the sweet spot. The method also includes striking, with the sweet spot, a golf ball. 20.

In some implementations, the method also includes, before the mounting, releasably attaching the arm to the link by inserting a pin of the arm into an aperture of the link.

In some implementations, the aligning includes manually aligning a visual marker of a link arm of the link with a central marker of the head.

DETAILED DESCRIPTION

The present disclosure relates to a putter training aid used to help train a user to strike a golf ball with the sweet spot of the golf putter. The putter training aid has two tabs that bound a region of the impact face of the golf putter, constraining the impact face to strike the golf ball with the sweet spot of the impact face. The putter training aid has a stability arm that bears against the shaft of the golf putter to add stability to the putter training aid.

Particular implementations of the subject matter described in this specification can be implemented so as to realize one or more of the following potential advantages. For example, the putter training aid of the present disclosure can be quickly installed on the putter and quickly removed to allow a user to use the putter without the putter training aid. Additionally, the putter training aid of the present disclosure has a hybrid or universal design, allowing a user to mount the putter training aid on different types and models of golf putters.

Figure 1:
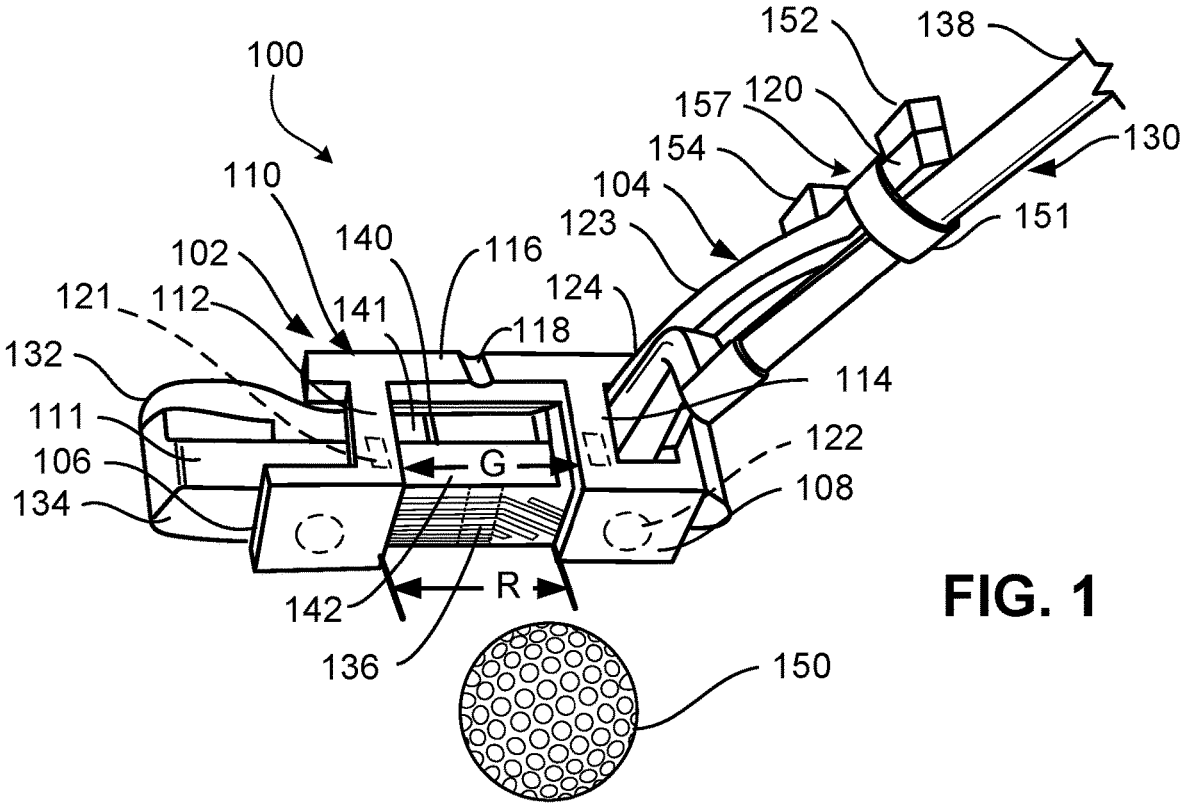
FIG. 1 is a perspective view of a putter training aid mounted on a golf putter.

FIG. 1 illustrates a putter training aid 100 (e.g., a putting aid or a training assembly) that has a bracket 102 (e.g., a putter training aid bracket) and an arm 104 (e.g., a putter training aid arm or stability arm). The arm 104 is releasably attached to the bracket 102. The putter training aid 100 can be quickly mounted on and removed from a golf club 130 (e.g., a golf putter). The golf putter 130 has a shaft 138 and a head 132 attached to an end of the shaft 138 opposite a handle (not shown) of the shaft 138. The putter training aid 100 helps train a user to strike a golf ball 150 with the "sweet spot" 136 of the impact face 134 (e.g., the clubface) of the head 132 of the golf putter 130.

The putter training aid 100 can be made, for example, of metal (e.g., steel, titanium, or aluminum), graphite, composite, plastic, fiberglass, wood, glass, ceramic, or a similar material. Additionally, different pieces can be made of different materials, or all the pieces can be made of the same material. For example, the bracket 102 can be made of a rigid or generally rigid material (e.g. metal) and the arm 104 can be made of a slightly less rid material (e.g., a plastic such as PVC that allows the arm to bend slightly). In some cases, the different parts of the bracket 102 (or of the arm 104) can be made of different materials.

Additionally, the putter training aid 100 can be formed as a single unitary piece or multiple pieces connected together. For example, the putter training aid 100 can be made as one piece or multiple pieces using injection molding, 3D printing, computer numerical control (CNC) machining, etc. For instance, the bracket 102 can be formed as one piece and the arm 104 as another piece. In some cases, different parts of the bracket 102 (or the arm 104) can be made separately and then attached together using adhesives, mechanical fasteners, (e.g., screws or bolts), snap-fit connections, or a similar connection.

The bracket 102 has a first tab 106, a second tab 108, and a link 110 coupled (e.g., attached, fixed, releasably attached, or adjustably attached) to the first tab 106 and the second tab 108. When mounted on the head 132, the first and second tabs 106, 108 reside at the impact face 134. The tabs 106, 108 have a square shape and span all or the majority of the height of the impact face 134. For example, depending on the type of putter 130, the height of the tabs 106, 108 can be similar or equivalent to the height of the putter head 132. The side surfaces of the tabs 106, 108 that face each other are straight to make the training aid 100 sensitive to the ball at ball impact. The tabs 106, 108 help train a user to be "square" at ball impact and to stay square at backstroke and release. In some implementations, the tabs 106, 108 can have a different shape (e.g., rectangular or round) and can have angled edges to strike the ball during bad putting strokes.

The second tab 108 is spaced from the first tab 106 to define a gap "G" therebetween. When installed on the head 132, the gap "G" corresponds with a region "R" of the impact face 134. The region "R" is an area of the impact face 134 that is bounded by (and defined between) the first and second tabs 106, 108. To hit the ball with the region "R," a user has to hit the ball 150 with the center of the region "R." Otherwise, one of the tabs 106, 108 strikes the ball 150, sending the ball 150 to the side and thus indicating a miss-hit.

The bracket 102 also has a link 110 coupled to the tabs 106, 108. The link 110 has, in top view, a "C-shape" to allow a user to see a top surface 111 and cavity 141 of the head 132. Specifically, the link 110 has a first arm 112, a second arm 114, and a link arm 116 coupled to the first and second arms 112, 114. The first arm 112 is coupled to the first tab 106 and it extends back from a back surface of the first tab 106. The second arm 114 is coupled to the second tab 108 and it extends back from a back surface of the second tab 108.

The link arm 116 has a visual marker 118 (e.g., a slot or line) at the center of a top surface of the link arm 116. The user can move the bracket 102 to align the visual marker 118 with a central marker 140 (e.g., a centerline) of the putter head 132. The central marker 140 is aligned with the sweet spot 136 of the impact face 134. In other words, when the visual marker 118 is aligned with the central marker 140, the visual marker 118 is aligned with the sweet spot 136.

Because the visual marker 118 is aligned with a mid-point of the gap "G," when the visual marker 118 is aligned with the central marker 140 the mid-point of the gap "G" is aligned with and corresponds to the sweet spot 136. Thus, with the bracket 102 aligned, the region "R" of the impact face 134 includes the sweet spot and the sweet spot is at the mid-point of the region "R". Thus, with the bracket 102 aligned, the first and second tabs 106, 108 constrain the region "R" of the impact face 134 to strike the golf ball 150 only with the sweet spot 136. In other words, the region "R" cannot strike the golf ball 150 with any other area of the region "R" other than the sweet spot 136, as any miss-hits result in striking the ball with one of the tabs 106, 108.

The central marker 140 can be at the back cavity 141 of the putter head 132 (as shown in FIG. 1) or at the top surface 111 of the head 132. The arms of the bracket 102 are sized to form a gap between the top surface 111 and the link arm 116 so that a user can see the central marker 140 (whether the marker 140 is at the cavity 141 or the top surface 111) from above the putter head 132 while putting.

The sweet spot 136 refers to a specific area of the impact face 134 where the golf ball 150 should be hit for optimal results. The sweet spot is aligned with the center marker 140 and can be at the center of the impact face 134 or offset from the center. In some cases, the sweet spot 136 can be located by using impact tape during practice and recording where the 'best feeling' shot struck on the impact face 134. The sweet spot 136 can be a circular area or, as shown in FIG. 1, it can have a different area such as a rectangular area spanning part or all the height of the impact face 134.

As further described in detail below with respect to FIGS. 4 and 5, the bracket 102 can have one or more magnets 121, 122 to attach the bracket 102 to the putter head 132. The magnets include two arm magnets 121 and two tab magnets 122. When the bracket 102 is mounted on the putter head 132, the arm magnets 121 face the top surface 111 and the tab magnets 121 face the impact face 134. The magnets 121, 122 maintain the bracket 102 in place during use, adding stability to the bracket 102. For example, when the putter head 132 is made of a magnetic material (e.g., steel), the arm magnets 121, 122 and tab magnets 121 attach to the top surface 111 and impact face 134 respectively to maintain the bracket 102 in place.

The stability arm 104 is attached to the link arm 116 of the bracket 102. The stability arm 104 extends from the link arm 116 along a length of the shaft 138 and bears against the shaft 138 to push the link arm 116 backwards, adding stability to the bracket 102 (and to the putter training aid 100 as a whole). Pushing the link arm 116 applies a force on the first and second tabs 106 to bear tightly against the impact face 134.

The stability arm 104 has a first arm section 120, a second arm section 124, and third arm section 123 (e.g., a middle arm section) coupled to and disposed between the first and second arm sections 120, 124. The first arm section 120 has a first surface that bears against the shaft 138. The second arm section 124 has a second surface that faces away from the first surface and bears against the link arm 116. The third arm section 123 extends at an angle with respect to the first and second arm sections 120, 124 to form a type of spring that biases the link arm 116 away from the impact face 134. As further described in detail below with respect to FIG. 2, the first arm section 120 has a magnet that can secure the arm 104 to the shaft. The force applied by the stability arm 104 to the link arm 116 biases the two tabs 106, 108 toward the impact face 134 of the golf putter 130. Thus, the force applied by the stability arm 104 to the bracket 102 adds stability to the mounted bracket 102.

Additionally, the first arm section 120 can have tabs 152, 154 on a back surface of the first arm section 120. The tabs 152, 154 form a gap or slot 157 in between the two tabs 152, 154. In some cases, the slot 157 can serve as a strap retainer for a strap 151 that secures the arm 104 to the shaft 138. For example, when the shaft is made of a non-magnetic material such as aluminum, the user can wrap around a strap 151 (e.g., a hook-and-loop strap) around the slot 157 and the shaft 138 to secure the stability arm 104 to the shaft 138.

Figure 2:
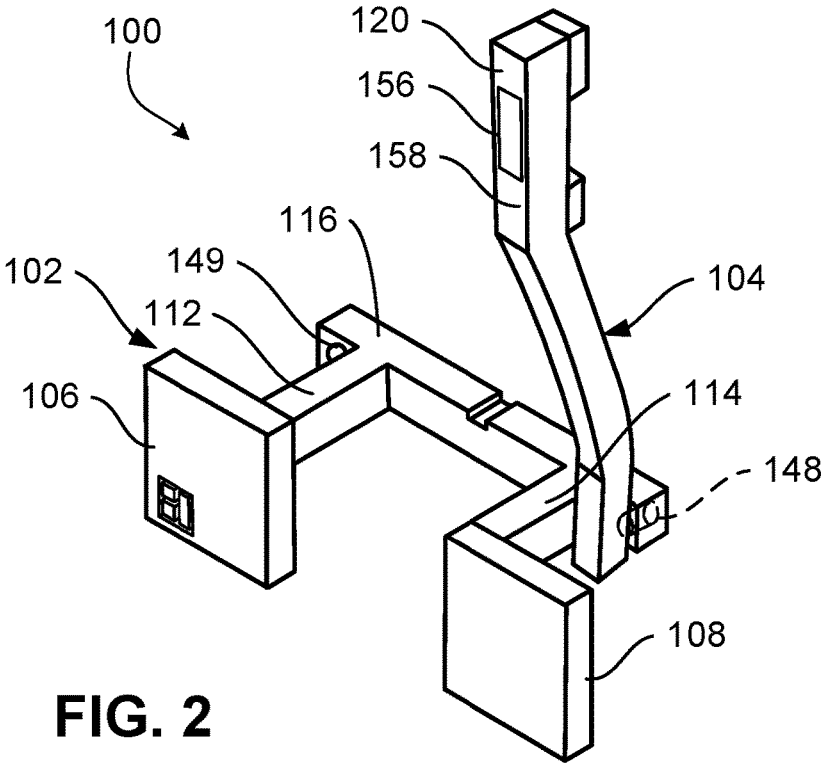
FIG. 2 is a schematic, perspective view of the putter training aid.

FIG. 2 shows a schematic, perspective view of the putter training aid 100 assembled. As further described in detail below with respect to FIG. 3, the stability arm 104 has a pin that is used to attach the arm 104 to the bracket 102. Specifically, the pin of the arm 104 is inserted into a hole 148 of the bracket 102 to releasably attach the stability arm 104 to the bracket 102. The link arm 116 has two shoulders that extend outwardly from the bracket arms 112, 114 and have respective surfaces that face the back surfaces of the tabs 106, 108. Each shoulder has a respective hole 148, 149 to snuggly receive the pin of the stability arm 104. For example, the hole 148 to the right side of FIG. 2 is used to attach the arm 104 to the bracket 102 when using the training aid 100 on a right-handed putter (as shown in FIG. 1), and the hole 149 to the left is used to attach the arm 104 to the bracket 102 to be used with a left-handed putter. In some implementations, the arm 104 can be fixed to the bracket 102 so that the putter training aid 100 is a one-piece training aid.

The first arm section 120 of the stability arm 104 has a bearing surface 158 that bears against the shaft of the golf putter. The bearing surface 158 has a magnet 156 that attaches to shafts made of magnetic material (e.g., steel).

The magnet 156 is disposed within a cavity of the first arm section 120 so that the front surface of the magnet 156 is generally flush with the bearing surface 158 (or below the bearing surface) of the first arm section 120.

Figure 3:
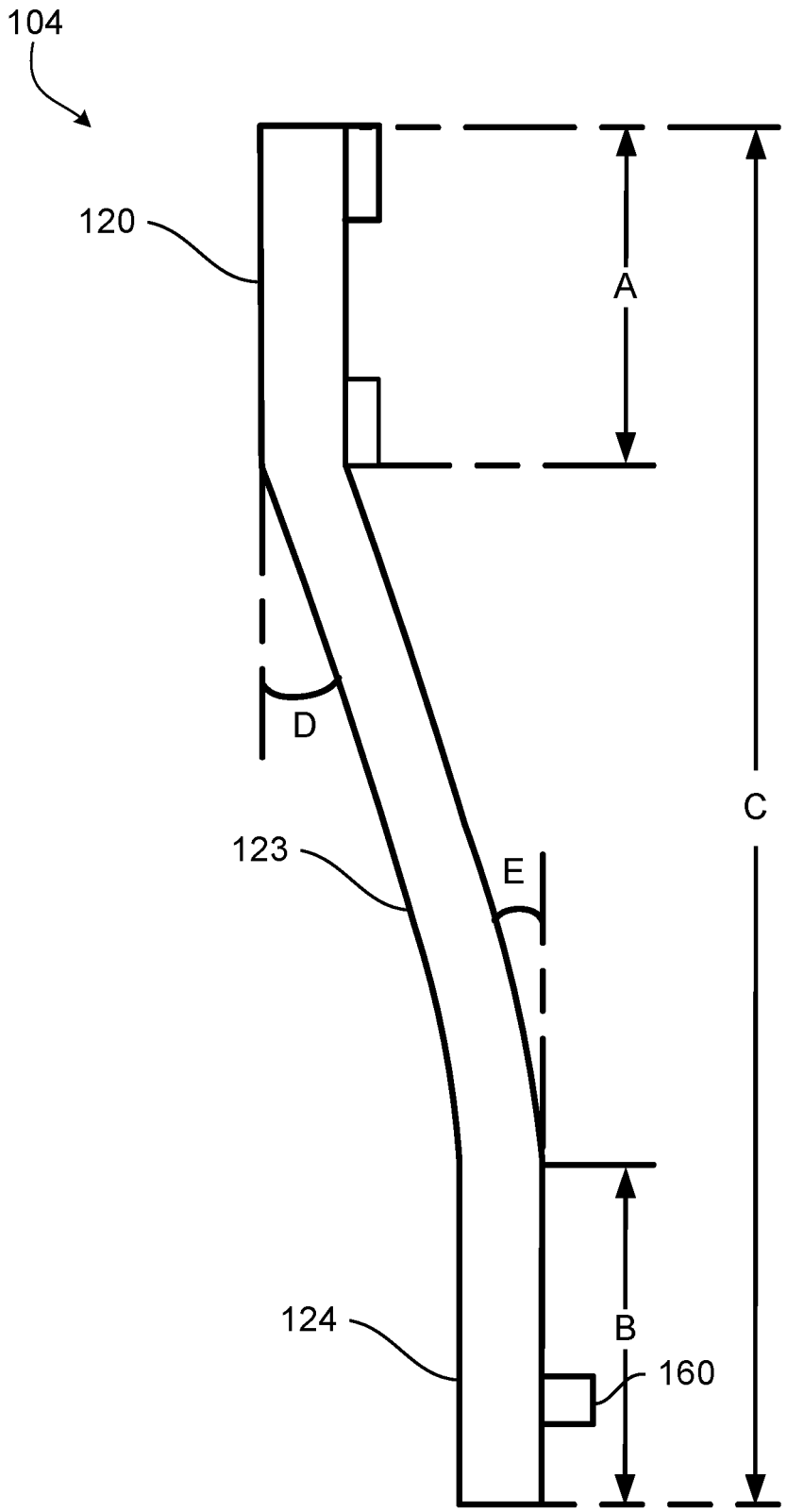
FIG. 3 is a side view of a stability arm of the putter training aid.

FIG. 3 shows a side view of the stability arm 104. The first arm section 120 and the second arm section 124 can extend vertically in a parallel or generally parallel direction with respect to each other. The second arm section 124 has the pin 160 that extends from a back surface of the second arm section 124. The back surface of the second arm section 124 bears, with the pin 160 inserted into the aperture of the bracket, against the link arm of the bracket. In some cases, instead of a pin 160 and hole connection, the second arm section 124 can connect to the bracket using a different type of connection such as a magnetic coupling, a hook-and-loop connection, a threaded connection (e.g., a screw or nut and bolt connection), or a snap-fit connection.

The middle arm section 123 extends, in side view, at an angle with respect to the straight first section 120 and the straight second section 124. For example, the middle arm section 123 extends at an angle "D" of, for example, between 10° and 30° (e.g., 16°) with respect to the first arm section 120. The middle arm section 123 is slanted at an angle "E" of, for example, between 10° and 30° (e.g., 16°) with respect to the second arm section 124. The middle section 123 can be straight from the first section to the second section. The stability arm 104 is generally symmetric along its length, with a central plane along its length dividing, in front view, the arm 104 into two equal or generally equal parts.

The first arm section 120 has a length "A" of, for example, between 0.5 and 1.5 inches (e.g., 1 inch). The second arm section 124 has a length "B" that is similar to or equal to the length "A." The arm has a total length "C" (e.g. vertical height) of, for example, between 3.5 and 4.5 inches (e.g., 4.15 inches).

Figure 4:
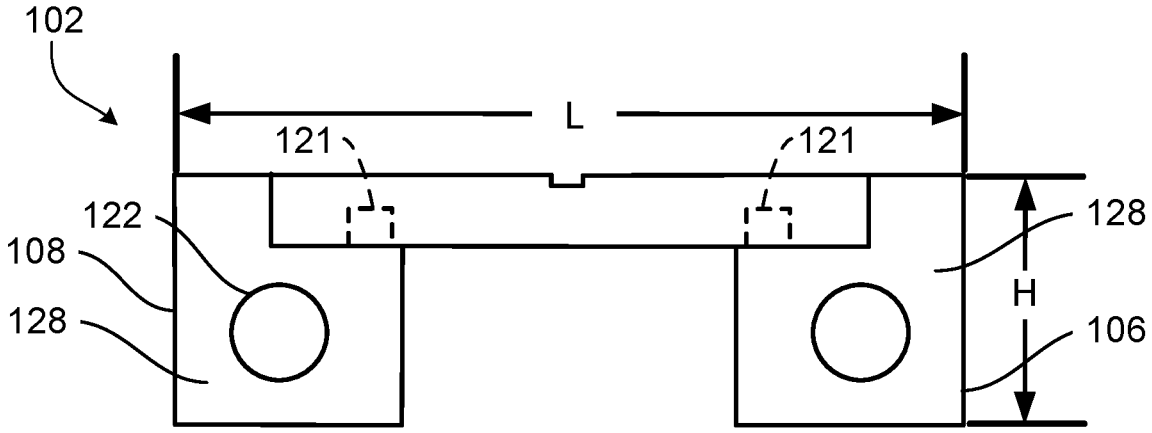
FIG. 4 is a back view of a bracket of the putter training aid.
Figure 5:
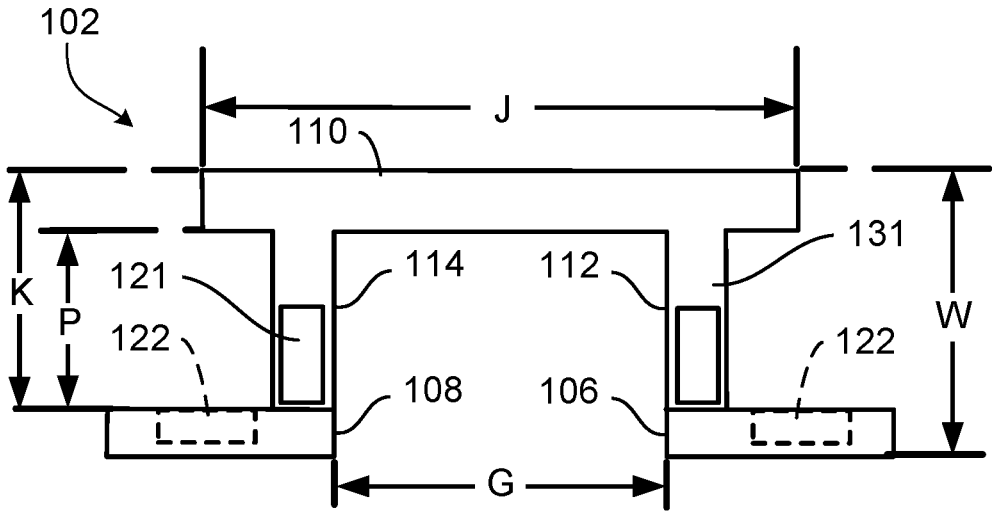
FIG. 5 is a bottom view of the bracket of the putter training aid.

FIGS. 4 and 5 show a back view and a top view of the bracket 102, respectively. As depicted in FIG. 4, the two tabs 106, 108 have magnets 122 at a back surface 128 of the tabs 106, 108. As shown in FIG. 5, the tab magnets 122 are attached to and disposed within a cavity of the tabs 122 and are generally flush with the back surface 128 of the tabs 106, 108. FIG. 5 shows the arm magnets 121 at the bottom surface 131 of the arms 112, 114. Referring also to FIG. 4, the arm magnets 121 are attached to and disposed within a cavity of the arms 112, 114 and are generally flush with the bottom surface 131 of the arms 112, 114.

The bracket 102 (and each tab 106, 108) has a height "H" of, for example, between 0.5 and 1.5 inches (e.g., 1.05 inches), a total length "L" of, for example, between 2.5 and 4 inches (e.g., 3.3 inches), and a width "W" of, for example, between 0.5 and 1.5 inches (e.g., 1.2 inches). The link 110 has a width "K" of, for example, between 0.5 and 1.2 inches (e.g., 1 inch) and a length "J" of, for example, between 2 and 3 inches (e.g., 2.5 inches). Additionally, the gap "G" between the tabs 106, 108 is, for example, between 1 and 2 (e.g., 1.4 inches) inches long, and the arms 112, 114 have a length "P" of, for example, between 0.5 and 2 inches (e.g., 0.75 inches). The putter training aid 100 can accommodate different sizes and shapes of putters. Specifically, the angles D, E and dimensions A, B, C, H, L, G, P, J, K, and W are intended to meet such need to make the putter training aid 100 as universal as reasonably possible.

Figure 6:
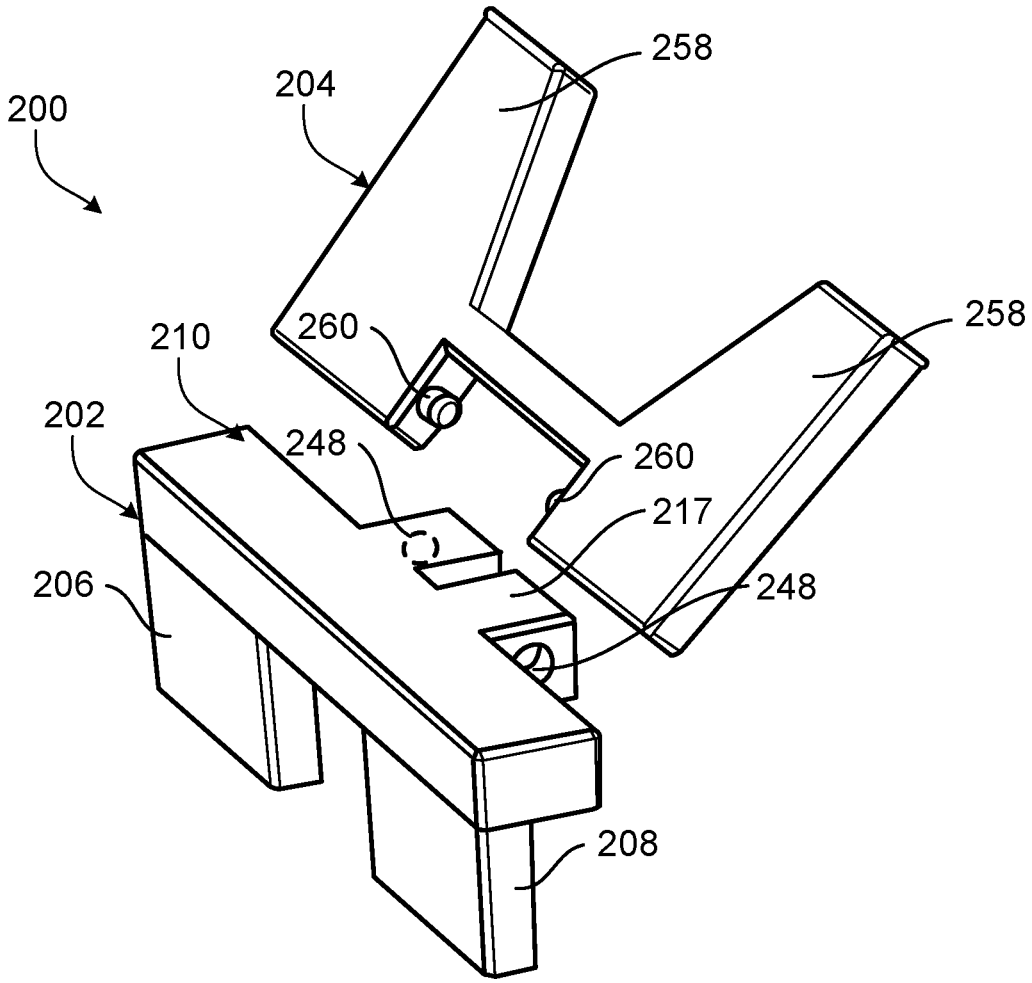
FIG. 6 is a perspective view of a putter training aid according to a second implementation of the present disclosure

FIG. 6 illustrates a putter training aid 200 according to a second implementation of the present disclosure. The putter training aid 200 is similar to the putter training aid 100 in FIG. 1 and can be similarly used by releasably mounting the putter training aid 200 on a putter. Similar to the putter training aid 100 in FIG. 1, the putter training aid 200 can have magnets (to attach it to the putter), and the training aid 200 can be formed as a unitary piece or in separate parts that are assembled together.

The putter training aid 200 has a bracket 202 and a stability arm 204 that attaches to the bracket 202. The bracket 202 has two tabs 206, 208 that bound the surface of the putter that includes the sweet spot. The bracket 202 also has a link 21 fixed to the tabs 206, 208. The bracket 202 is similar to the bracket 102 in FIG. 1, with the main exception of the link 210 having two knuckles 217 that form a hinge-like connection with the stability arm 204. For example, the stability arm 204 has two pins 260 that face each other and correspond with two apertures 248 of the knuckles 217 that face away from each other. The pins 260 are inserted into the apertures 248 to form a connection about which the arm 204 can pivot.

The stability arm has bearing surfaces 258. The bearing surfaces 258 attach to the shaft of a putter with magnets or with another type of connection. The bearing surface 258 to the right of FIG. 6 bears against the shaft of a right-handed putter (and the bearing surface to the left bears against the shaft of a left-handed putter) to apply backward pressure on the hinge-like connection, pushing the tabs 206, 208 against the impact face of the putter. The pressure of the tabs 206, 208 against the impact surface of the putter adds stability to the training aid 200.

Figure 7:
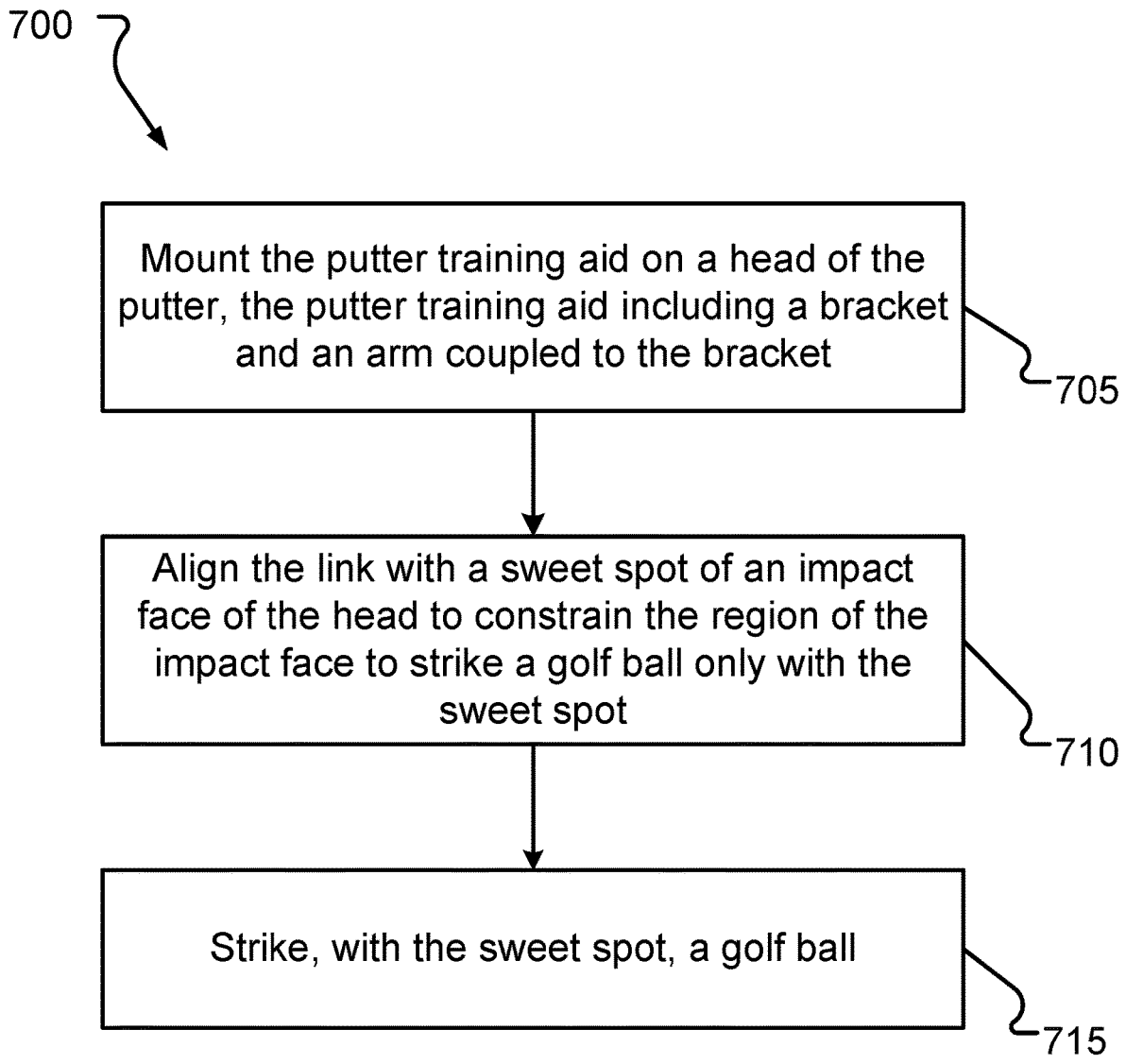
FIG. 7 is a flow chart of a method of using the putter training aid.

FIG. 7 shows a flow chart of an example method 700 of using the putter training aid of the present disclosure. The method includes mounting the putter training aid on a head of the putter (705). The method also includes aligning the link with a sweet spot of an impact face of the head to constrain the region of the impact face to strike a golf ball only with the sweet spot (710). The method also includes striking the golf ball with the sweet spot (715).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component.

Furthermore, it is to be understood that the mere use of the term "first" and "second" does not require that there be any "third" component, although that possibility is contemplated under the scope of the present disclosure.

What is claimed is:

1. A putter training aid assembly, comprising:

a bracket comprising:

a first tab, a second tab spaced from the first tab, and a link fixed to the first tab and the second tab, the link configured to align, with the bracket releasably mounted on a head of a golf putter, with a sweet spot of an impact face of the head to position the first tab and the second tab at the impact face bounding a region of the impact face comprising the sweet spot; and an arm configured to be coupled to the link, the arm configured to bear, with the putter training aid assembly releasably mounted on the head and the arm engaging the link, against a surface of a shaft of the golf putter to bias the first tab and the second tab against the impact face;

wherein the first tab and the second tab are configured to constrain, with the putter training aid assembly releasably mounted on the head and the link aligned with the sweet spot, the region of the impact face to strike a golf ball only with the sweet spot;

wherein the arm comprises a first end comprising a first surface and a second end opposite the first end and comprising a second surface facing away from the first surface, the arm comprising a middle section angled with respect to the first end and second end, the first surface configured to bear, with the putter training aid assembly releasably mounted on the head and the arm engaging the link, against the shaft and the second surface configured to bear against the link to urge the first tab and second tab against the impact face of the golf putter, adding stability to the mounted brackets.

2. The putter training aid assembly of claim 1, wherein the shaft is made of a magnetic material and the first surface comprises a magnet configured to magnetically couple the arm to the shaft, the second surface comprising a pin configured to be inserted into an aperture of the link to releasably couple the arm to the link and allow, with the putter training aid assembly mounted on the head, the arm to push the link in a direction away from the impact face of the head.

3. The putter training aid assembly of claim 1, wherein the link comprises:

a first tab arm fixed to and extending from the first tab, a second tab arm fixed to and extending from the second tab, and a link arm fixed to the first tab arm and the second tab arm, the link arm configured to form, with the bracket mounted on the head and the first tab arm and the second tab arm resting on a top surface of the head, a space between the link arm and the top surface of the head to allow a user to see, from above the head and while putting, a central marker disposed at a cavity of the head or the top surface of the head or both, the central marker aligned with the sweet spot of the impact face.

4. The putter training aid assembly of claim 3, wherein the head is made of a magnetic material and at least one of the first tab arm or the second tab arm comprises a magnet, the magnet facing, with the bracket mounted on the head, the top surface to magnetically couple the bracket to the top surface.

5. The putter training aid assembly of claim 3, wherein the first tab arm and the second tab arm have a length of between 0.5 and 2 inches, and the first and second tabs define a gap therebetween, the gap being between 1 and 2 inches long.

6. A putter training aid arm, comprising:

a first arm section comprising a first surface;

a second arm section extending parallel with respect to the first arm section and comprising a second surface facing away from the first surface; and a third arm section fixed to and disposed between the first arm section and the second arm section, the third arm section extending at an angle with respect to the first arm section and the second arm section, the putter training aid arm configured to extend from a putter training aid bracket releasably mounted on a head of a golf putter such that, with the putter training aid bracket and the putter training aid arm mounted on the head, the first surface bears against a shaft of the golf putter and the second surface biases two tabs of the putter training arm bracket against an impact face of the golf putter, adding stability to the mounted putter training aid bracket.

7. The putter training aid arm of claim 6, wherein the third arm section extends at angle of between 10° and 30° with respect to the first arm section and the second arm section.

8. The putter training aid arm of claim 6, wherein the shaft is made of a magnetic material and the first surface comprises a magnet configured to magnetically couple the arm to the shaft, the second surface comprising an engagement member configured to interface with a coupling surface of the link facing the second surface to releasably couple the arm to the link and allow, with the putter training aid arm and bracket mounted on the head, the arm to push the link in a direction away from the impact face of the head and thereby bias the two tabs of the putter training arm bracket against the impact face of the golf putter.

9. The putter training aid arm of claim 8, wherein the engagement member comprises a pin and the coupling surface of the link comprises a corresponding hole configured to receive the pin to engage with the arm.

10. The putter training aid arm of claim 8, wherein the coupling surface of the link extends outwardly from a link arm of the link to face the shaft or a back surface of the head such that the arm engages the shaft and the coupling surface with the link disposed along a plane extending across the coupling surface and the shaft.

11. The putter training aid arm of claim 6, wherein the arm extends along a central plane of the arm extending along the length of the arm, the first surface and the second surface comprising respective longitudinal central axes aligned with the central plane, and wherein the arm is either fixed to the bracket or configured to be releasably coupled to the bracket.

12. A method of using a putter training aid, comprising:

mounting the putter training aid on a head of the putter, the putter training aid comprising a bracket and an arm coupled to the bracket, the bracket comprising a first tab, a second tab spaced from the first tab, and a link fixed to the first tab, the arm attached to the link and bearing against a shaft of the putter;

aligning the link with a sweet spot of an impact face of the head to position the first tab and the second tab at the impact face bounding a region of the impact face comprising the sweet spot to constrain the region of the impact face to strike a golf ball only with the sweet spot; and striking, with the sweet spot, a golf ball;

the method further comprising, before the mounting, releasably attaching the arm to the link by inserting a pin of the arm into an aperture of the link.

13. The method of claim 12, wherein the aligning comprises manually aligning a visual marker of a link arm of the link with a central marker of the head.

* * * * *